US009845546B2

(12) United States Patent
Nashner

(10) Patent No.: US 9,845,546 B2
(45) Date of Patent: Dec. 19, 2017

(54) SUB-SURFACE MARKING OF PRODUCT HOUSINGS

(75) Inventor: Michael Nashner, San Jose, CA (US)

(73) Assignee: APPLE INC., Cupertino, CA (US)

( * ) Notice: Subject to any disclaimer, the term of this patent is extended or adjusted under 35 U.S.C. 154(b) by 910 days.

(21) Appl. No.: 12/643,772

(22) Filed: Dec. 21, 2009

(65) Prior Publication Data

US 2011/0088924 A1 Apr. 21, 2011

Related U.S. Application Data

(60) Provisional application No. 61/252,623, filed on Oct. 16, 2009.

(51) Int. Cl.

| | |
|---|---|
| ***H05K 5/03*** | (2006.01) |
| ***H05K 5/04*** | (2006.01) |
| ***B65D 6/00*** | (2006.01) |
| ***B65D 88/18*** | (2006.01) |
| ***B65D 88/04*** | (2006.01) |
| ***B65D 88/06*** | (2006.01) |
| ***B65D 85/00*** | (2006.01) |
| ***C25D 11/02*** | (2006.01) |
| ***C25D 11/04*** | (2006.01) |
| ***C25D 11/28*** | (2006.01) |
| ***B41M 5/24*** | (2006.01) |

(Continued)

(52) U.S. Cl.

CPC ..... *C25D 11/04* (2013.01); *C25D 11/022* (2013.01); *C25D 11/024* (2013.01); *C25D 11/18* (2013.01); *C25D 11/26* (2013.01)

(58) Field of Classification Search

CPC ... H05K 5/03; H05K 5/04; B65D 7/42; B65D 2203/00; B65D 8/18; B65D 8/04; B65D 8/06; B65D 85/00; C25D 11/02; C25D 11/04; C25D 11/28; B41M 5/24

USPC ..... 220/4.02, 626; 206/459.5; 174/520, 559; 361/679.02

See application file for complete search history.

(56) References Cited

U.S. PATENT DOCUMENTS

| | | | |
|---|---|---|---|
| 2,647,079 | A | 7/1953 | Burnham |
| 2,812,295 | A | 11/1957 | Patrick |

(Continued)

FOREIGN PATENT DOCUMENTS

| | | | |
|---|---|---|---|
| CN | 1362125 | A | 8/2002 |
| CN | 1306526 | C | 3/2007 |

(Continued)

OTHER PUBLICATIONS

Annerfors et al., "Nano Molding Technology on Cosmetic Aluminum Parts in Mobile Phones", Division of Production and Materials Engineering, LTH, 2007.

(Continued)

*Primary Examiner* — Andrew T Kirsch

(74) *Attorney, Agent, or Firm* — Brownstein Hyatt Farber Schreck, LLP

(57) ABSTRACT

Techniques or processes for providing markings on products are disclosed. In one embodiment, the products have housings and the markings are to be provided on sub-surfaces of the housings. For example, a housing for a particular product can include an outer housing surface and the markings can be provided on a sub-surface the outer housing surface yet still be visible from the outside of the housing. Since the markings are beneath the surface of the housing, the markings are durable.

20 Claims, 11 Drawing Sheets

(51) Int. Cl.
*C25D 11/18* (2006.01)
*C25D 11/26* (2006.01)

(56) References Cited

U.S. PATENT DOCUMENTS 2,990,304 A 6/1961 Cybriwsky et al.
3,080,270 A 3/1963 Fritz
3,216,866 A 11/1965 Orlin
3,526,694 A 9/1970 Lemelson
3,615,432 A 10/1971 Jenkins et al.
3,645,777 A 2/1972 Sierad
RE28,225 E 11/1974 Heseltine et al.
2,346,531 A 1/1981 Adachi et al.
4,247,600 A 1/1981 Adachi et al.
4,269,947 A 5/1981 Inata et al.
4,347,428 A * 8/1982 Conrad et al. ..... 219/251
4,531,705 A 7/1985 Nakagawa et al.
4,547,649 A 10/1985 Butt et al.
4,564,001 A 1/1986 Maeda
4,651,453 A 3/1987 Doyle
4,686,352 A 8/1987 Nawrot et al.
4,756,771 A 7/1988 Brodalla et al.
4,931,366 A 6/1990 Mullaney
4,993,148 A 2/1991 Adachi et al.
5,215,864 A 6/1993 Laakmann
5,224,197 A 6/1993 Zanoni et al.
5,288,344 A 2/1994 Peker et al.
5,417,905 A 5/1995 Lemaire et al.
5,645,964 A 7/1997 Nohr et al.
5,719,379 A 2/1998 Huang et al.
5,744,270 A 4/1998 Pearlman et al.
5,789,466 A 8/1998 Birmingham et al.
5,808,268 A 9/1998 Balz
5,837,086 A 11/1998 Leeb et al.
5,872,699 A 2/1999 Nishii et al.
5,925,847 A 7/1999 Rademacher et al.
5,943,799 A 8/1999 Xu et al.
5,971,617 A * 10/1999 Woelki et al. ..... 384/295
6,007,929 A 12/1999 Robertson et al.
6,101,372 A 8/2000 Kubo
6,169,266 B1 1/2001 Hughes
6,325,868 B1 12/2001 Kim et al.
6,331,239 B1 12/2001 Shirota et al.
6,480,397 B1 11/2002 Hsu et al.
6,540,867 B1 4/2003 Cochran
6,574,096 B1 6/2003 Difonzo et al.
6,590,183 B1 * 7/2003 Yeo ..... 219/121.69
6,633,019 B1 10/2003 Gray
6,746,724 B1 6/2004 Robertson et al.
6,802,952 B2 * 10/2004 Hsu ..... 205/121
6,821,305 B2 11/2004 Yan
6,966,133 B2 11/2005 Krings et al.
6,996,425 B2 2/2006 Watanabe
7,065,820 B2 6/2006 Meschter
7,134,198 B2 11/2006 Nakatani et al.
7,181,172 B2 2/2007 Sullivan et al.
7,225,529 B2 6/2007 Wang
7,284,396 B2 10/2007 Barron et al.
7,459,373 B2 12/2008 Yoo
7,508,644 B2 3/2009 Cheung et al.
7,530,491 B2 * 5/2009 Lasch et al. ..... 235/380
7,622,183 B2 11/2009 Shirai et al.
7,636,974 B2 12/2009 Meschter et al.
7,691,189 B2 4/2010 En et al.
8,192,815 B2 6/2012 Weber et al.
8,367,304 B2 2/2013 Heley et al.
8,379,678 B2 2/2013 Zhang et al.
8,379,679 B2 2/2013 Zhang et al.
8,451,873 B2 5/2013 Zhang
8,663,806 B2 3/2014 Weber et al.
8,761,216 B2 6/2014 Zhang
8,809,733 B2 8/2014 Scott et al.
8,842,351 B2 9/2014 Lawrence et al.
8,879,266 B2 11/2014 Jarvis et al.
8,893,975 B2 11/2014 Sanford et al.
8,993,921 B2 3/2015 Browning et al.
9,034,166 B2 5/2015 Tatebe et al.
9,089,932 B2 7/2015 Lim
9,132,510 B2 9/2015 Nashner et al.
9,133,559 B2 9/2015 Silverman
9,138,826 B2 9/2015 Harrison
9,173,336 B2 10/2015 Bhatia
9,185,835 B2 11/2015 Heley et al.
2001/0030002 A1 10/2001 Zheng et al.
2002/0058737 A1 5/2002 Nishiwaki et al.
2002/0097440 A1 7/2002 Paricio et al.
2002/0109134 A1 8/2002 Iwasaki et al.
2002/0130441 A1 9/2002 Robinson et al.
2002/0160145 A1 10/2002 Bauhoff
2003/0006217 A1 1/2003 Dance
2003/0024898 A1 2/2003 Natsume et al.
2003/0074814 A1 4/2003 Krings et al.
2003/0225189 A1 12/2003 Fuller
2004/0000490 A1 1/2004 Chang
2005/0023022 A1 2/2005 Kriege et al.
2005/0034301 A1 2/2005 Wang
2005/0115840 A1 6/2005 Dolan
2005/0127123 A1 6/2005 Smithers
2005/0158576 A1 7/2005 Groll
2005/0211680 A1 * 9/2005 Li et al. ..... 219/121.68
2005/0263418 A1 12/2005 Bastus
2006/0007524 A1 1/2006 Tam
2006/0055084 A1 3/2006 Yamaguchi et al.
2006/0066771 A1 3/2006 Hayano et al.
2006/0105542 A1 5/2006 Yoo
2006/0225918 A1 10/2006 Chinda et al.
2007/0018817 A1 1/2007 Marmaropoulos et al.
2007/0045893 A1 3/2007 Asthana et al.
2007/0053504 A1 3/2007 Sato et al.
2007/0262062 A1 11/2007 Guth
2007/0275263 A1 11/2007 Groll
2008/0105960 A1 5/2008 See et al.
2008/0152859 A1 6/2008 Nagal
2008/0165485 A1 7/2008 Zadesky et al.
2008/0166007 A1 7/2008 Hankey
2008/0216926 A1 9/2008 Guo et al.
2008/0241478 A1 10/2008 Costin et al.
2008/0274375 A1 11/2008 Ng et al.
2008/0295263 A1 12/2008 Meschter et al.
2008/0299408 A1 12/2008 Guo et al.
2008/0311369 A1 12/2008 Yokoyama et al.
2009/0017242 A1 1/2009 Weber et al.
2009/0019737 A1 1/2009 Moreno
2009/0091879 A1 4/2009 Lim
2009/0104949 A1 4/2009 Sato et al.
2009/0136723 A1 5/2009 Zhao
2009/0190290 A1 7/2009 Lynch et al.
2009/0194444 A1 8/2009 Jones
2009/0197116 A1 8/2009 Cheng et al.
2009/0236143 A1 9/2009 Nakamura
2009/0260871 A1 10/2009 Weber et al.
2009/0305168 A1 12/2009 Heley et al.
2010/0015578 A1 1/2010 Falsafi et al.
2010/0061039 A1 3/2010 Sanford et al.
2010/0065313 A1 3/2010 Takeuchi et al.
2010/0159273 A1 6/2010 Filson et al.
2010/0183869 A1 7/2010 Lin et al.
2010/0209721 A1 8/2010 Irikura et al.
2010/0209731 A1 8/2010 Hamano
2010/0294426 A1 11/2010 Nashner
2010/0300909 A1 12/2010 Hung
2011/0008618 A1 1/2011 Weedlun
2011/0048755 A1 3/2011 Su et al.
2011/0051337 A1 3/2011 Weber et al.
2011/0089039 A1 4/2011 Nashner et al.
2011/0089067 A1 4/2011 Scott et al.
2011/0123737 A1 5/2011 Nashner et al.
2011/0186455 A1 8/2011 Du et al.
2011/0193928 A1 8/2011 Zhang
2011/0193929 A1 8/2011 Zhang et al.
2011/0194574 A1 8/2011 Zhang et al.
2011/0253411 A1 10/2011 Hum et al.
2011/0315667 A1 12/2011 Reichenbach et al.
2012/0043306 A1 2/2012 Howerton et al.

(56) References Cited

U.S. PATENT DOCUMENTS

| | | | |
|---|---|---|---|
| 2012/0081830 | A1 | 4/2012 | Yeates et al. |
| 2012/0100348 | A1 | 4/2012 | Brookhyser et al. |
| 2012/0248001 | A1 | 10/2012 | Nashner |
| 2012/0275130 | A1 | 11/2012 | Hsu et al. |
| 2013/0075126 | A1 | 3/2013 | Nashner et al. |
| 2013/0083500 | A1 | 4/2013 | Prest et al. |
| 2013/0129986 | A1 | 5/2013 | Heley et al. |
| 2014/0000987 | A1 | 1/2014 | Peacock et al. |
| 2014/0134429 | A1 | 5/2014 | Weber et al. |
| 2014/0186654 | A1 | 7/2014 | Zhang |
| 2014/0363608 | A1 | 12/2014 | Russell-Clarke et al. |
| 2014/0367369 | A1 | 12/2014 | Nashner et al. |
| 2014/0370325 | A1 | 12/2014 | Nashner et al. |
| 2015/0093563 | A1 | 4/2015 | Runge et al. |
| 2015/0132541 | A1 | 5/2015 | McDonald et al. |
| 2015/0176146 | A1 | 6/2015 | Browning et al. |

FOREIGN PATENT DOCUMENTS

| | | | |
|---|---|---|---|
| CN | 201044438 | Y | 2/2008 |
| CN | 101204866 | | 6/2008 |
| CN | 102173242 | A | 9/2011 |
| DE | 195 23 112 | | 6/1996 |
| DE | 102005048870 | A1 | 4/2007 |
| EP | 0031463 | | 7/1981 |
| EP | 0 114 565 | A1 | 8/1984 |
| EP | 121150 | A1 | 10/1984 |
| EP | 0234121 | | 9/1987 |
| EP | 0 633 585 | A | 1/1995 |
| EP | 0 997 958 | A1 | 5/2000 |
| EP | 2 399 740 | A1 | 12/2011 |
| EP | 2488369 | B1 | 3/2014 |
| GB | 788 329 | A | 12/1957 |
| JP | 57-149491 | A | 9/1982 |
| JP | 03 013331 | A | 1/1991 |
| JP | 03 138131 | A | 6/1991 |
| JP | 3-203694 | A | 9/1991 |
| JP | 06-126192 | | 5/1994 |
| JP | A H06-212451 | | 8/1994 |
| JP | 06-320104 | | 11/1994 |
| JP | 7-204871 | A | 8/1995 |
| JP | 2000-000167 | | 1/2000 |
| JP | 2002/370457 | | 12/2002 |
| JP | 2003055794 | | 2/2003 |
| JP | 2005/22924 | | 1/2005 |
| JP | A2006-138002 | | 6/2006 |
| JP | 2008 087409 | A | 4/2008 |
| WO | WO 98/53451 | | 11/1998 |
| WO | EP 0 997 958 | A1 | 5/2000 |
| WO | WO 0077883 | | 12/2000 |
| WO | WO 01/15916 | A1 | 3/2001 |
| WO | WO 01/34408 | | 5/2001 |
| WO | WO 2006/124279 | A2 | 11/2006 |
| WO | WO 2007/088233 | A1 | 8/2007 |
| WO | WO 2008/092949 | A1 | 8/2008 |
| WO | WO 2009/051218 | A1 | 4/2009 |
| WO | WO 2010/095747 | A1 | 8/2010 |
| WO | WO 2010/111798 | A1 | 10/2010 |
| WO | WO 2010/135415 | | 11/2010 |
| WO | WO 2010/135415 | A2 | 11/2010 |
| WO | WO 2011/047325 | A1 | 4/2011 |

OTHER PUBLICATIONS

International Search Report and Written Opinion for PCT Application No. PCT/US2010/052931, dated Nov. 24, 2010.

Office Action for Chinese Utility Model Patent Application No. 201020660662.9, dated Mar. 9, 2011.

"Thermal Shock Resistant Conformal Coating", Product Data Sheet, Dymax Corporation, Jul. 9, 2007, pp. 1-2.

"Marking Lasers: Marking without Limitations", Trumpf Inc., Sep. 10, 2007, pp. 1-36.

"UV-Curing Sheet Adhesives", ThreeBond Technical News, Issued Jul. 1, 2009, 8 pages.

Chang, "Lasers Make Other Metals Look Like Gold", New York Times, nytimes.com, 2 pgs., Jan. 31, 2008.

"Database EPI" Week 201107 Thomas Scientific, London, GB; AN 2010-Q46184, Nov. 17, 2010, 1 pg.

International Preliminary Report for International Patent Application PCT/US2010/052931, dated Apr. 26, 2012.

Office Action for Chinese Patent Application No. 10771612.8, dated Jan. 30, 2013.

Search Report for Chinese Patent Application No. 10771612.8, dated Jan. 8, 2013.

Office Action for U.S. Appl. No. 12/895,384, dated Jun. 27, 2013.

Office Action for Taiwanese Patent Application No. 099135329, dated Apr. 23, 2013.

Examination Report for EP Patent Application No. 10771612.8, dated Apr. 19, 2013.

Second Office Action for Chinese Patent Application No. 201010582694.6, dated Aug. 30, 2013.

Office Action for Mexican Patent Application No. Mx/a/2012/004375, dated Oct. 23, 2013.

Office Action for Taiwanese Patent Application No. 099135329, dated Oct. 25, 2013.

Last Preliminary Rejection for Korean Patent Application No. 10-2012-7012468, dated Nov. 28, 2013.

Notice of Allowance for U.S. Appl. No. 12/895,384, dated Dec. 24, 2013.

Office Action for U.S. Appl. No. 12/895,384, dated Feb. 10, 2014.

Rejection Decision for Chinese Patent Application No. 201010582694.6, dated Jan. 20, 2014.

Office Action for Mexican Patent Application No. Mx/a/2012/004375, dated Apr. 25, 2014.

"DP2UV Basick System 2 W", ROBA Technology + Services GmbH, Aug. 2008, 2 pgs.

Final Office Action for U.S. Appl. No. 12/895,384, dated Dec. 22, 2014.

Final Office Action for U.S. Appl. No. 12/895,384, dated Sep. 5, 2014.

Bereznai et al., "Surface Modifications Induced by NS and Sub-PS Exciter Laser Pulses on Titanium Implanted Material", Bio Materials, Elsevier Science Publishers vol. 24, No. 23, Oct. 1, 2003, pp. 4197-4203.

Lopez et al., "Comparison of picosecond and femtosecond laser ablation for surface engraving of metals and semiconductors", Proceedings of Spie, vol. 8243, Feb. 9, 2012, p. 824300.

Rusu et al., "Titanium Alloy Nanosecond vs. femtosecond laser marking", Applied Surface Science, vol. 259, Oct. 1, 2012, pp. 311-319.

Shah, Vishu, Handbook of Plastics Testing and Failure Analysis, John Wiely & Sons;, Inc., Third Edition, Jun. 14, 2006.

Rejection Decision for Chinese Patent Application No. 201010582694.6, dated Mar. 12, 2015.

Office Action for U.S. Appl. No. 12/895,384, dated Sep. 30, 2010.

Zhao et al., Anodizing Behyavior of aluminum foil Patterned with SiO2 Mask, Aug. 2005, Journal of Electrochemical Society, vol. 152 (10), pp. B411-B414.

Hajdu, "Chaper 7", 1990, William Andrew Publishing from www.knovel.com, pp. 193-206.

* cited by examiner

SUB-SURFACE MARKING OF PRODUCT HOUSINGS

CROSS-REFERENCE TO RELATED APPLICATION

This application claims priority benefit of U.S. Provisional Application No. 61/252,623, filed Oct. 16, 2009 and entitled "SUB-SURFACE MARKING OF PRODUCT HOUSINGS," which is hereby incorporated herein by reference.

BACKGROUND OF THE INVENTION

Field of the Invention

The present invention relates to marking products and, more particularly, marking outer housing surfaces of electronic devices.

Description of the Related Art

Consumer products, such as electronic devices, have been marked with different information for many years. For example, it is common for electronic devices to be marked with a serial number, model number, copyright information and the like. Conventionally, such marking is done with an ink printing or stamping process. Although conventional ink printing and stamping is useful for many situations, such techniques can be inadequate in the case of handheld electronic devices. The small form factor of handheld electronic devices, such as mobile phones, portable media players and Personal Digital Assistants (PDAs), requires that the marking be very small. In order for such small marking to be legible, the marking must be accurately and precisely formed. Unfortunately, however, conventional techniques are not able to offer sufficient accuracy and precision. Thus, there is a need for improved techniques to mark products.

SUMMARY OF THE INVENTION

The invention pertains to techniques or processes for providing markings on products. In one embodiment, the products have housings and the markings are to be provided on sub-surfaces of the housings. For example, a housing for a particular product can include an outer housing surface and the markings can be provided on a sub-surface the outer housing surface yet still be visible from the outside of the housing. Since the markings are beneath the surface of the housing, the markings are durable. The markings provided on products can be textual and/or graphic. The markings can be formed with high resolution. The markings are also able to be dark, even on metal surfaces.

In general, the markings (also referred to as annotations or labeling) provided on products according to the invention can be textual and/or graphic. The markings can be used to provide a product (e.g., a product's housing) with certain information. The marking can, for example, be use to label the product with various information. When a marking includes text, the text can provide information concerning the product (e.g., electronic device). For example, the text can include one or more of: name of product, trademark or copyright information, design location, assembly location, model number, serial number, license number, agency approvals, standards compliance, electronic codes, memory of device, and the like). When a marking includes a graphic, the graphic can pertain to a logo, a certification mark, standards mark or an approval mark that is often associated with the product. The marking can be used for advertisements to be provided on products. The markings can also be used for customization (e.g., user customization) of a housing of a product.

The invention can be implemented in numerous ways, including as a method, system, device, or apparatus. Several embodiments of the invention are discussed below.

As a method for marking an article, one embodiment can, for example, include at least providing a metal structure for the article, anodizing at least a first surface of the metal structure; and subsequently altering surface characteristics of selective portions of an inner unanodized surface of the metal structure. In one embodiment, the altering of the surface characteristics can be performed by directing a laser output through the anodized first surface of the metal structure towards the inner unanodized surface of the metal structure.

As an electronic device housing, one embodiment of the invention can, for example, include at least a housing structure that includes at least an outer portion and an inner portion. The outer portion is anodized and the inner portion is unanodized. In addition, to provide predetermined marking of the electronic device housing, a surface of the inner portion adjacent the outer portion has selectively altered surface regions.

As a housing arrangement, one embodiment of the invention can, for example, include a base metal layer, an additional layer, and sub-surface marking indicia. The additional layer has a first bonding surface and a first exterior surface. The first bonding surface is bonded to a first surface of the base metal layer, and the first exterior surface serves as an exterior of the housing arrangement. The sub-surface marking indicia are formed on the first surface of the base metal layer.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

The invention pertains to techniques or processes for providing markings on products. In one embodiment, the products have housings and the markings are to be provided on sub-surfaces of the housings. For example, a housing for a particular product can include an outer housing surface and the markings can be provided on a sub-surface the outer housing surface yet still be visible from the outside of the housing. Since the markings are beneath the surface of the housing, the markings are durable. The markings provided on products can be textual and/or graphic. The markings can be formed with high resolution. The markings are also able to be dark, even on metal surfaces.

In general, the markings (also referred to as annotations or labeling) provided on products according to the invention can be textual and/or graphic. The markings can be used to provide a product (e.g., a product's housing) with certain information. The marking can, for example, be use to label the product with various information. When a marking includes text, the text can provide information concerning the product (e.g., electronic device). For example, the text can include one or more of: name of product, trademark or copyright information, design location, assembly location, model number, serial number, license number, agency approvals, standards compliance, electronic codes, memory of device, and the like). When a marking includes a graphic, the graphic can pertain to a logo, a certification mark, standards mark or an approval mark that is often associated with the product. The marking can be used for advertisements to be provided on products. The markings can also be used for customization (e.g., user customization) of a housing of a product.

Exemplary embodiments of the invention are discussed below with reference to FIGS. 1-11. However, those skilled in the art will readily appreciate that the detailed description given herein with respect to these figures is for explanatory purposes as the invention extends beyond these limited embodiments.

Figure 1:
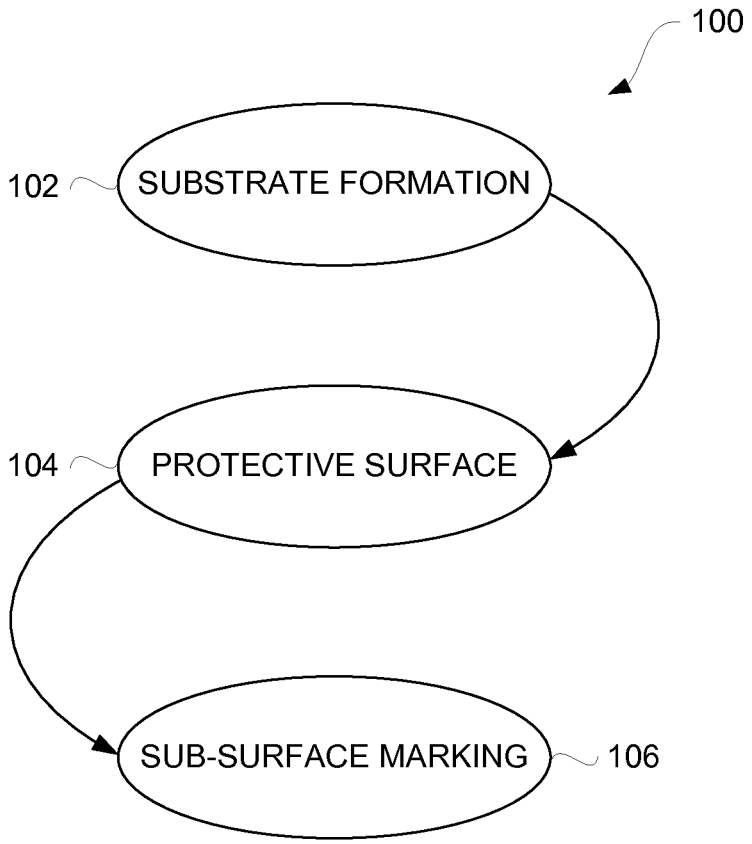
FIG. 1 is a diagram of a marking state machine according to one embodiment of the invention.

FIG. 1 is a diagram of a marking state machine 100 according to one embodiment of the invention. The marking state machine 100 reflects three (3) basic states associated with marking an electronic device. Specifically, the marking can mark a housing of an electronic device, such as a portable electronic device.

The marking state machine 100 includes a substrate formation state 102. At the substrate formation state 102, a substrate can be obtained or produced. For example, the substrate can represent at least a portion of a housing surface of an electronic device. Next, the marking state machine 100 can transition to a protective surface state 104. At the protective surface state 104, a protective surface can be formed or applied to at least one surface of the substrate. The protective surface can be used to protect the surface of the substrate. For example, the protective surface can be a more durable surface than that of the surface. Next, the marking state machine 100 can transition to a sub-surface marking state 106. At the sub-surface marking state 106, marking can be produced on a sub-surface of the substrate. In particular, the sub-surface marking can be performed on the substrate below the protective surface. The protective surface is typically substantially translucent to allow the sub-surface marking to be visible through the protective surface. The marking can be provided with high resolution and can be protected. Since the marking is provided on a sub-surface, the marking is not only protected but also has the cosmetic advantage of not being perceptible of tactile detection on the surface.

Figure 2:
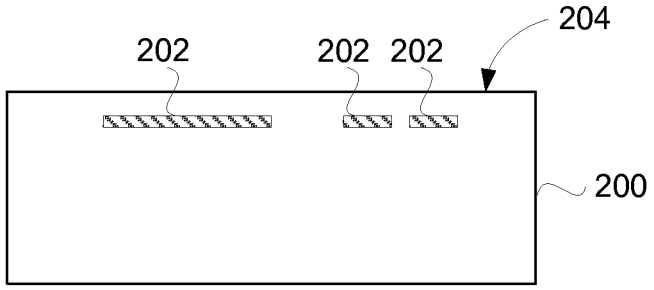
FIG. 2 is an illustration of a substrate having sub-surface alterations 202 according to one embodiment.

FIG. 2 is an illustration of a substrate 200 having sub-surface alterations 202 according to one embodiment. The sub-surface alterations 202 are provided below an outer surface 204 of the substrate 200. Given that the outer surface 204 is typically substantially translucent (e.g., clear), the sub-surface alterations 202 are visible by a user through the outer surface 204. Accordingly, the sub-surface alterations 202 can provide markings on the substrate 200. Since the markings are provided by the sub-surface alterations 202, the markings are protected by the outer surface 204.

The substrate 200 can represent at least a portion of a housing of an electronic device. The marking being provided to the substrate can provide text and/or graphics to an outer housing surface of a portable electronic device. The marking techniques are particularly useful for smaller scale portable electronic devices, such as handheld electronic devices. Examples of handheld electronic devices include mobile telephones (e.g., cell phones), Personal Digital Assistants (PDAs), portable media players, remote controllers, pointing devices (e.g., computer mouse), game controllers, etc.

The marking is, in one embodiment, particularly well-suited for applying text and/or graphics to a housing of an electronic device. As noted above, the substrate can represent a portion of a housing of an electronic device. Examples of electronic devices, namely, handheld electronic devices, include mobile telephones (e.g., cell phones), Personal Digital Assistants (PDAs), portable media players, remote controllers, pointing devices (e.g., computer mouse), game controllers, etc.

Figure 3:
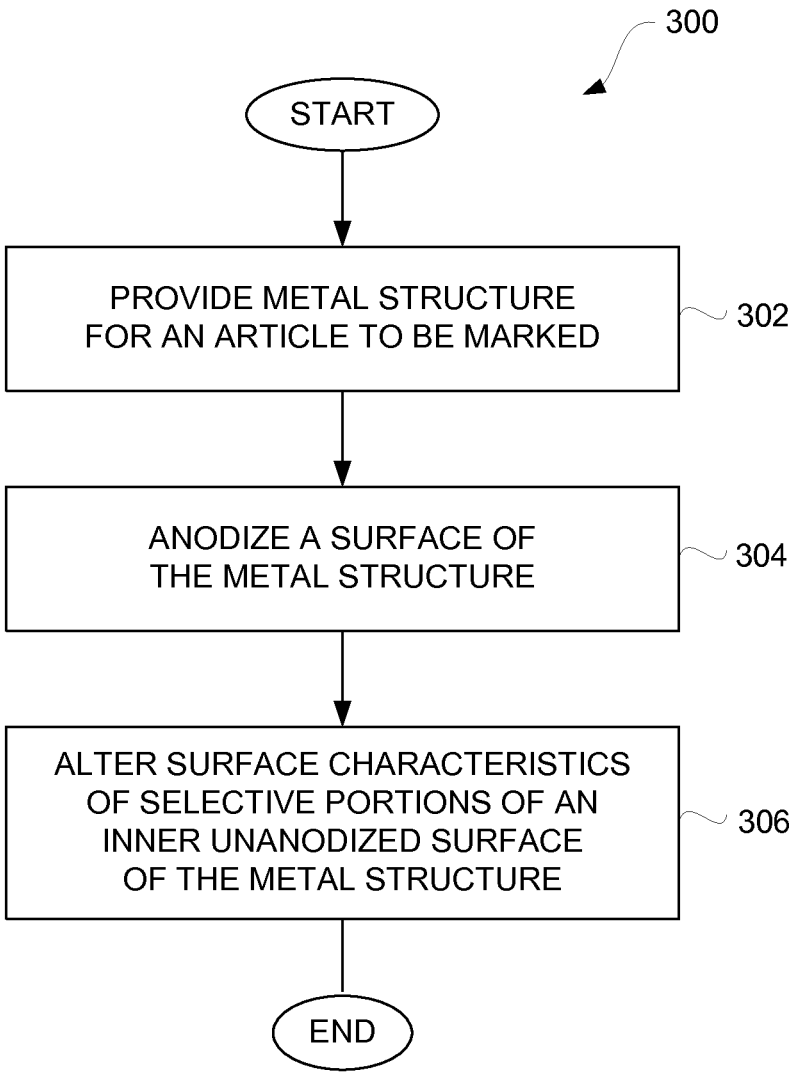
FIG. 3 is a flow diagram of a marking process according to one embodiment.

FIG. 3 is a flow diagram of a marking process 300 according to one embodiment. The marking process 300 can be performed on an electronic device that is to be marked. The marking process 300 is, for example, suitable for applying text or graphics to a housing (e.g., an outer housing surface) of an electronic device. The marking can be provided such that it is visible to users of the electronic device. However, the marking can be placed in various different positions, surfaces or structures of the electronic device.

The marking process 300 can provide 302 a metal structure for an article to be marked. The metal structure can pertain to a metal housing for an electronic device, such as a portable electronic device, to be marked. The metal structure can be formed of one metal layer. The metal structure can also be formed of multiple layers of different materials, where at least one of the multiple layers is a metal layer. The metal layer can, for example, be or include aluminum, titanium, niobium or tantalum.

After the metal structure has been provided 302, a surface of the metal structure can be anodized 304. Typically, the surface of the metal structure to be anodized 304 is an outer or exposed metal surface of the metal structure. The outer or exposed surface typically represents an exterior surface of the metal housing for the electronic device. Thereafter, surface characteristics of selected portions of an inner unanodized surface of the metal structure can be altered 306. The inner unanodized surface can be part of the metal layer that was anodized, or part of another layer that was not anodized. The surface characteristics can be altered 306 using a laser, such as an infrared wavelength laser (e.g., picosecond pulsewidth infrared laser). For example, one specific suitable laser is a six (6) Watt infrared wavelength picosecond pulsewidth laser at 1000 KHz with a scan speed of 50 mm/sec. Following the block 306, the marking process 300 can end.

Figure 4A:
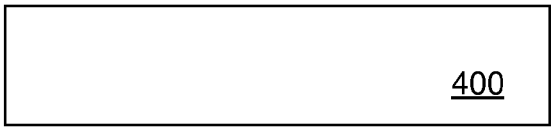
FIGS. 4A-4C are diagrams illustrating marking of a metal structure according to one embodiment.
Figure 4B:
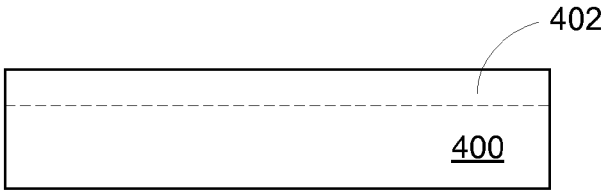
Figure 4C:
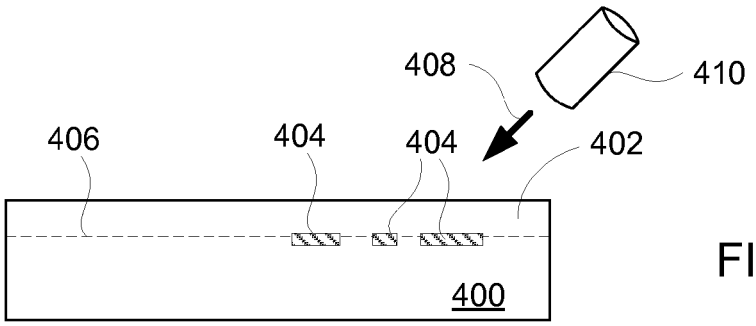

FIGS. 4A-4C are diagrams illustrating marking of a metal structure according to one embodiment. FIG. 4A illustrates a base metal structure 400. As an example, the base metal structure 400 can be formed of aluminum, titanium, niobium or tantalum. FIG. 4B illustrates the base metal structure 400 after an upper surface has been anodized to form an anodized surface 402. The thickness of the anodized surface 402 can, for example, be about 5-20 microns. After the anodized surface 402 has been formed on the base metal structure 400, FIG. 4C illustrates altered surfaces 404 being selectively formed on an inner unanodized surface 406. The altered structures 404 are formed by optical energy 408 produced by a laser 410 (e.g., infrared wavelength laser). The altered surfaces 404 combine to provide marking of the metal structure. For example, the altered surfaces 404 appear to be black and thus when selectively formed can provide marking. The resulting marking is visible through the anodized surface 402 which can be substantially translucent. If the anodized surface 402 is primarily clear, the resulting marking can be appear as black. The marking can also be provided in gray scale. If the anodized surface is dyed or colored, the markings may appear in different colors.

Figure 5:
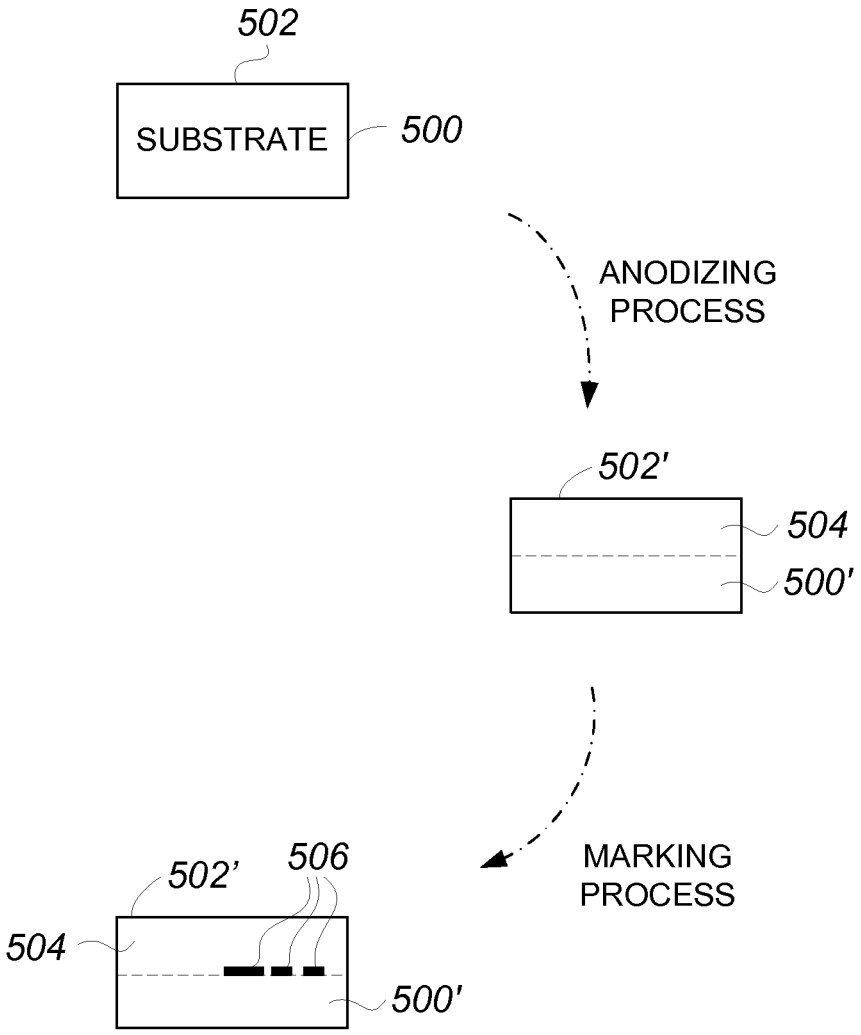
FIG. 5 is a flow diagram of a multi-stage marking process according to another embodiment.

FIG. 5 is a flow diagram of a multi-stage marking process according to another embodiment. As shown in FIG. 5, a substrate 500 can be provided to an anodizing process that causes an anodized surface 504 to be formed on at least one surface of the substrate 500. The substrate 500 includes an exposed surface 502. The anodizing provided by the anodizing process serves to anodize the exposed surface 502. Once anodized, the exposed surface 502 is an anodized exposed surface 502'. After the substrate 500 has been anodized by the anodizing process, the anodized substrate 500' can be provided to a marking process. The marking process operates to produce altered surfaces 506 to the anodized substrate 500' below the anodized exposed surface 502'. The altered surfaces 506 provide the marking to the anodized substrate 500'. By controlling size, placement and/or darkness of the altered surfaces 506, the marking can be selectively provided to the anodized substrate 500'.

Figure 6:
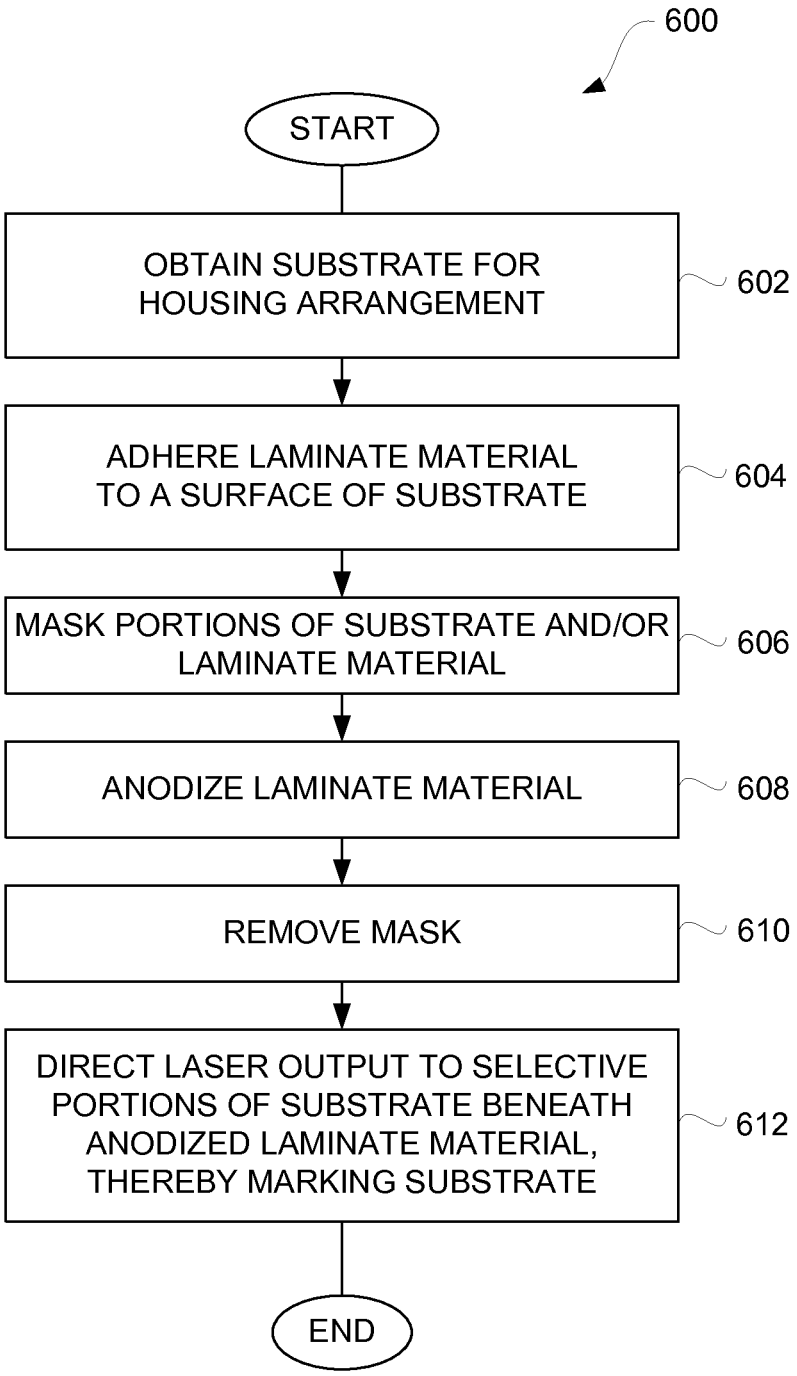
FIG. 6 is a flow diagram of a marking process according to one embodiment.

FIG. 6 is a flow diagram of a marking process 600 according to one embodiment. The marking process 600 can, for example, be performed by a marking system that serves to mark an electronic product. The marking process 600 can be performed on an electronic device that is to be marked. The marking process 600 is, for example, suitable for applying text or graphics to a housing (e.g., an outer housing surface) of the electronic device. The marking can be provided such that it is visible to a user of the electronic device. The marking can be placed in various different positions, surfaces or structures of the electronic device.

The marking process 600 can obtain 602 a substrate for a housing arrangement. Here, it is assumed that the electronic product to be marked includes a housing and that such housing is to be marked. After the substrate for the housing arrangement has been obtained 602, a laminate material can be adhered 604 to a surface of the substrate. In this embodiment, the laminate material is adhered 604 to the surface of the substrate to provide strength, cosmetic appeal, etc. For example, if the substrate is a metal, such as stainless steel, then the laminate layer can pertain to aluminum) or other material capable of being anodized).

Next, portions of the substrate can be masked 606. Here, since the substrate is going to undergo an anodization process, those portions of the substrate that are not to be anodized can be masked 606. Masking prevents an anodization to certain surfaces of the substrate or the laminate material adhered to the substrate. After portions of the substrate or laminate material are masked, the laminate material (that is not been masked off) can be anodized 608. Following the anodization, the mask can be removed 610.

Thereafter, laser output from a laser can be directed 612 to selected portions of the substrate beneath the anodized laminate material, thereby marking of the substrate. Consequently, the marking is provided by the altered regions that are below the surface. These altered regions can be induced by the laser output on the surface of the substrate below the laminate material. Following the block 612, the marking process 600 can end since the laser serves to produce altered regions below the outer surface of the laminate material.

Figure 7A:
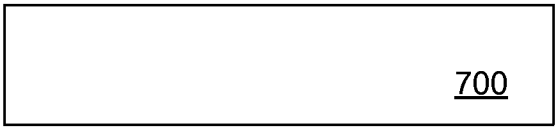
FIGS. 7A-7D are diagrams illustrating marking of a metal structure according to one embodiment.
Figure 7B:
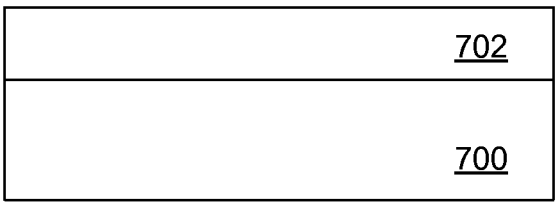
Figure 7C:
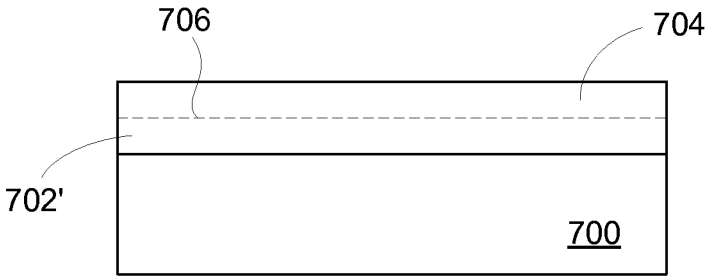
Figure 7D:
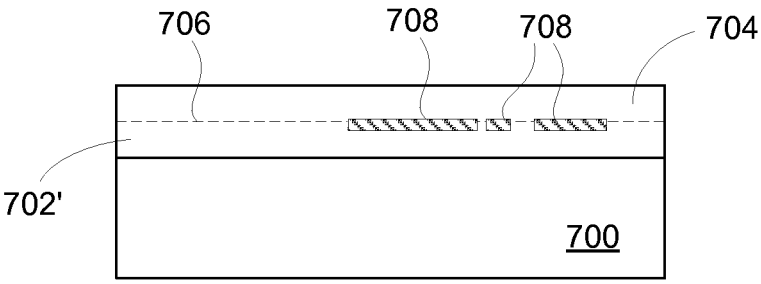

FIGS. 7A-7D are diagrams illustrating marking of a metal structure according to one embodiment. FIG. 7A illustrates a base metal layer 700. The base metal layer 700 can be a metal, such as stainless steel. FIG. 7B illustrates the base metal layer 700 after an outer metal layer 702 is provided on the base metal layer 700. The outer metal layer 702 can be a metal, such as aluminum, titanium, niobium or tantalum. FIG. 7C illustrates the metal structure 700 after the outer metal layer 702 has been anodized to form an anodized layer 704. After the anodized layer 704 has been formed, the outer metal layer 702 includes an outer portion representing the anodized layer 704 and an inner portion representing the unanodized portion of the outer metal layer 702. FIG. 7C also illustrated a representative boundary 706 between the outer portion and the inner portion of the anodized layer 704. Next, FIG. 7D illustrates altered surfaces 708 being selectively formed at the representative boundary 706. For example, the altered surfaces 708 can be formed on the unanodized portion of the outer metal layer 702. The altered structures 704 combine to provide marking of the metal structure. For example, the altered surfaces 708 appear to be black and thus when selectively formed can provide marking. The resulting marking is visible through the anodized surface 702 which can be substantially translucent. If the anodized surface 702 is primarily clear, the resulting marking can be appear as black. The marking can also be provided in gray scale. If the anodized surface is dyed or colored, the markings may appear in different colors.

Figure 8:
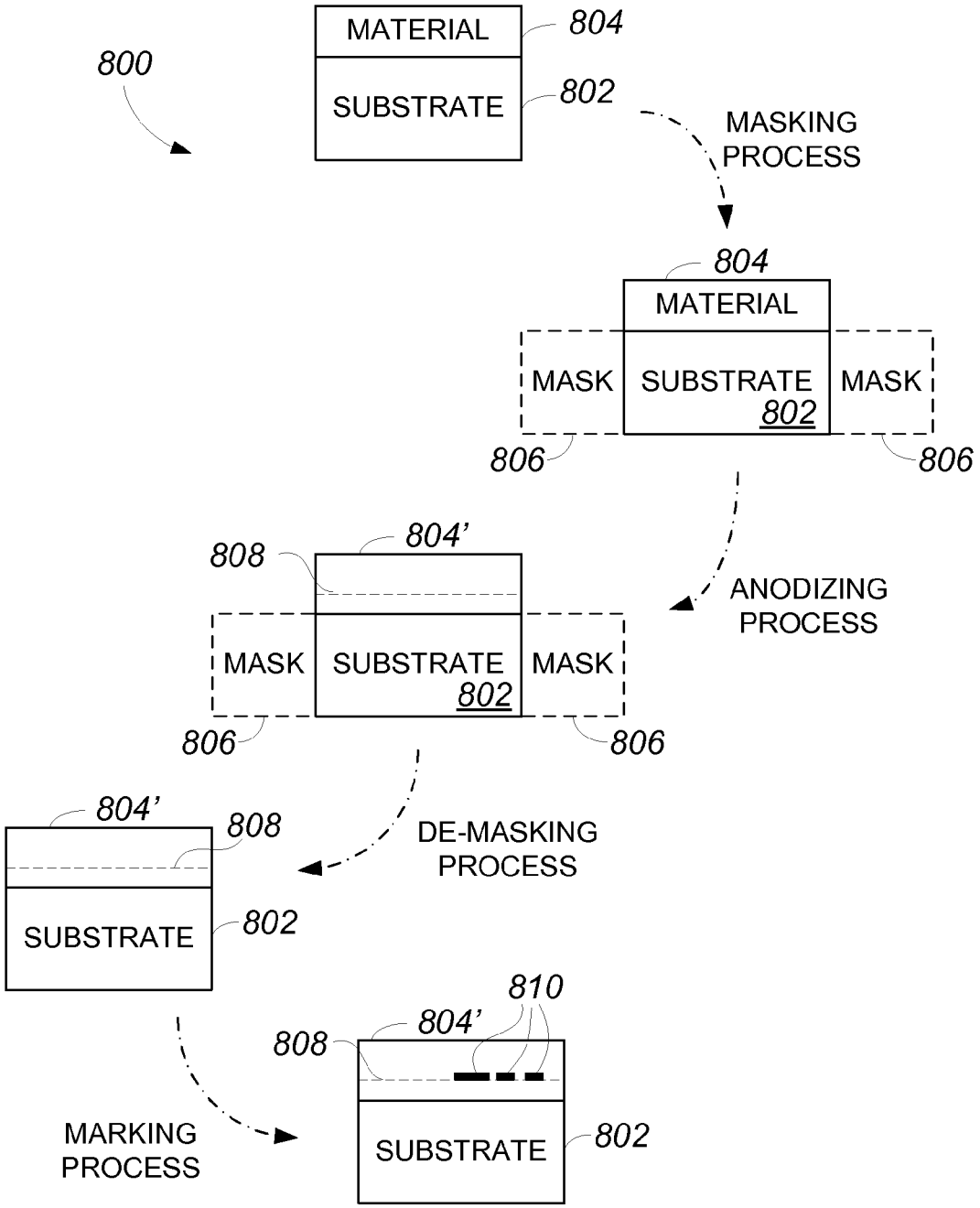
FIG. 8 is a flow diagram of a multi-stage marking process according to another embodiment.

FIG. 8 is a flow diagram of a multi-stage marking process 800 according to another embodiment. The marking process 800 can begin with a substrate 802 representing at least a portion of an article to be marked. As shown in FIG. 8, a substrate 802 can have a layer of material 804 adhered thereto. The layer of material 804 can generally formed from anodizable metals, i.e., metals which may be anodized. In one embodiment, the layer of material 804 can be aluminum, titanium, niobium or tantalum. The substrate 802 can be generally formed from non-anodizable metals, such as stainless steel.

The substrate 802 with the layer of material 804 can be provided to a masking process. At the masking process, portions of the substrate 802 can be "masked off" with mask material 806 that blocks anodization. The masking process generally does not mask off regions of the layer of material 804 but in some circumstances it may be desirable to do so.

After the masking has been completed at the masking process, the substrate 802 having the layer of material 804 and the mask 806 can be provided to an anodizing process. The anodizing process causes at least a portion of the layer of material 804 to be anodized. An anodized layer of material 804' is formed by the anodizing process. The anodized layer of material 804' is typically only anodized part way into the layer of material 804. A boundary 808 is established in the layer of material 804 between the anodized portion and the unanodized portion. The mask material 806 prevents anodization or damage to the substrate 802 during anodization.

Following anodization at the anodizing process, the substrate 802, the anodized layer of material 804' and the mask material 806 are provided to a de-masking process. At the de-masking process, the mask material 806 that was previously applied can now be removed since the anodization has been completed. Hence, following de-masking, the substrate 802 and the anodized layer of material 804' remain.

After the substrate 802 has been masked by the masking process, anodized by the anodizing process and de-masked by the de-masking process, the anodized substrate 802 with the anodized layer of material 804' can be provided to a marking process. At the marking process, the anodized layer of material 804' can be further processed to produce altered surfaces 810 at the boundary 808 in the anodized layer of material 804'. The altered surfaces 810 are thus below the surface of the anodized layer of material 804'. That is, in one embodiment, the altered surfaces 810 are induced into the unanodized portion of the layer of material 804' (i.e., portion below the boundary 808) as shown in FIG. 8. The altered surfaces 810 provide the marking to the layer of material 804. By controlling size, placement and/or darkness of the altered surfaces 810, the marking can be selectively provided to the article utilizing the substrate 802 and the anodized layer of material 804'. However, in an alternative embodiment, the altered surfaces 810 can be additionally or alternatively formed on the surface of the substrate 802 below the layer of material 804'.

The strength associated with stainless steel is generally desirable in the formation of housing walls for portable electronic devices including, but not limited to including, mobile phones (e.g., cell phones), portable digital assistants and digital media players. The stiffness associated with stainless steel is also desirable. However, the cosmetic properties of stainless steel are often lacking. To provide a cosmetic surface for a housing that effectively derives its strength from a stainless steel layer, an anodizable material may be clad to at least one surface of the stainless steel layer and then anodized. In one embodiment, a housing may include a stainless steel core that is substantially sandwiched between two layers of anodized material, e.g., anodized aluminum, which have a relatively high bond strength. The layers of anodized material effectively form cosmetic surfaces for the housing, while the stainless steel core provides structural strength, as well as stiffness, for the housing.

Figure 9:
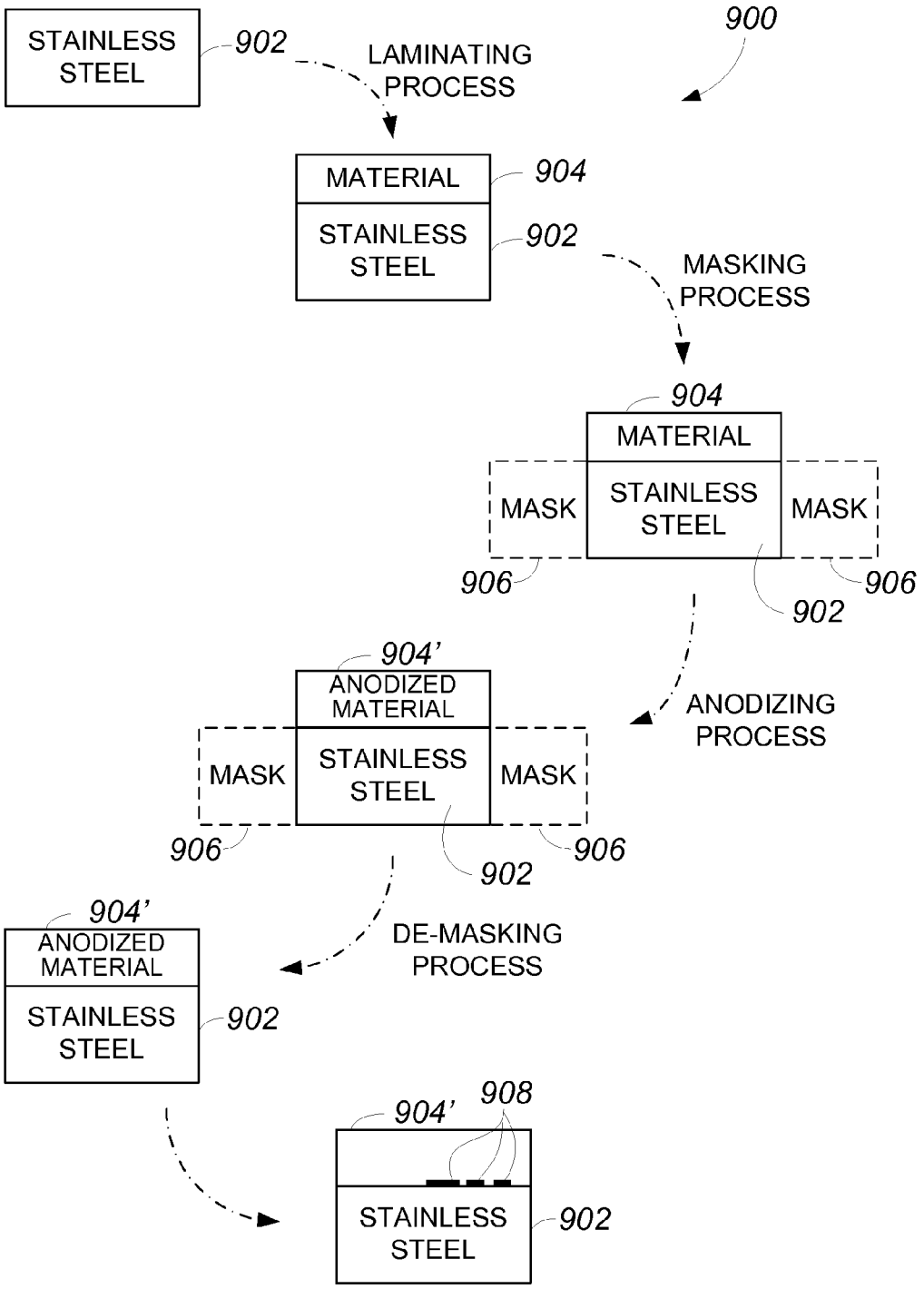
FIG. 9 is a flow diagram of a multi-stage marking process according to still another embodiment.

FIG. 9 is a flow diagram of a multi-stage marking process 900 according to still another embodiment. The marking process 900 can begin with a substrate 902 representing at least a portion of an article to be marked. In this embodiment, the substrate 902 is a layer of stainless steel. The substrate 902 can be can be provided to a laminating process. At the laminating process, the substrate 902 can have a layer of material 904 adhered thereto. The layer of material 904 can generally formed from anodizable metals, i.e., metals which may be anodized. In one embodiment, the layer of material 904 can be aluminum, titanium, niobium or tantalum. The layer of material 904 can be adhered to the substrate 904 by directly bonding the layer of material 904 to the substrate 902. For example, a cladding process can be used to bond the layer of material 904 to the substrate. As will be understood by those skilled in the art, a cladding is the bonding of metals substantially without an intermediate bonding agent and substantially without remelting the metals. Cladding may take a variety of different forms including, but not limited to including, standard cladding in which layer of material 904 and substrate 902 are pressed together with roller under high pressure, or fine cladding in which layer of material 904 and substrate 902 are placed in a vacuum and rolled together after a chemical process is performed.

Following the laminating process, the substrate 902 with the layer of material 904 can be provided to a masking process. At the masking process, portions of the substrate 902 can be "masked off" with mask material 906 that blocks anodization. The masking process generally does not mask off regions of the layer of material 904 but in some circumstances it may be desirable to do so.

After the masking has been completed at the masking process, the substrate 902 having the layer of material 904 and the mask 906 can be provided to an anodizing process. The anodizing process causes at least a portion of the layer of material 904 to be anodized. An anodized layer of material 904' is formed by the anodizing process. The anodized layer of material 904' may be anodized fully or part way into the layer of material 904. The mask material 906 prevents anodization or damage to the substrate 802 during anodization.

Following anodization at the anodizing process, the substrate 902, the anodized layer of material 904' and the mask material 906 are provided to a de-masking process. At the de-masking process, the mask material 806 that was previously applied can now be removed since the anodization has been completed. Hence, following de-masking, the substrate 902 and the anodized layer of material 904' remain.

After the substrate 902 has been masked by the masking process, anodized by the anodizing process and de-masked by the de-masking process, the anodized substrate 902 with the anodized layer of material 904' can be provided to a marking process. At the marking process, the anodized layer of material 904' can be further processed to produce altered surfaces 910 on the surface of the substrate 902 below the anodized layer of material 904'. The altered surfaces 910 are thus below the surface of the anodized layer of material 904'. That is, in one embodiment, the altered surfaces 910 are induced into the surface of the substrate 902 beneath at least the anodized portion of the layer of material 904'. The altered surfaces 910 provide the marking to the substrate 902. By controlling size, placement and/or darkness of the altered surfaces 910, the marking can be selectively provided to the article that uses the substrate 902.

Figure 10A:
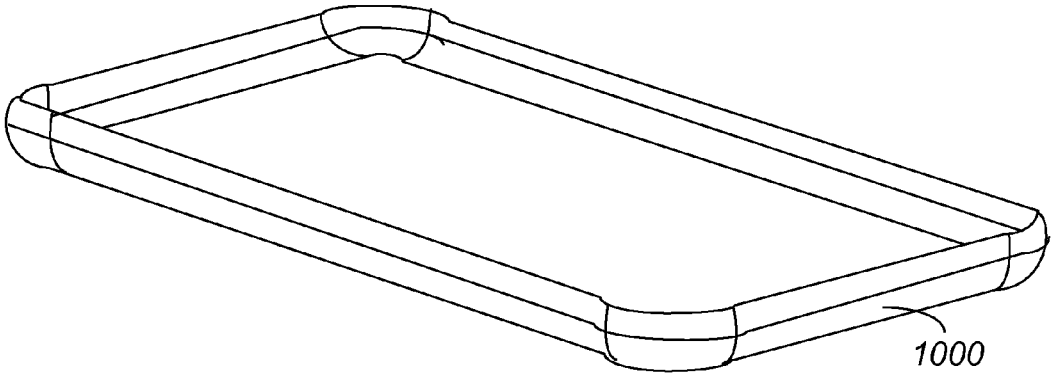
FIG. 10A is a diagrammatic representation of an exemplary housing 1000 on which a mask is to be placed.
Figure 10B:
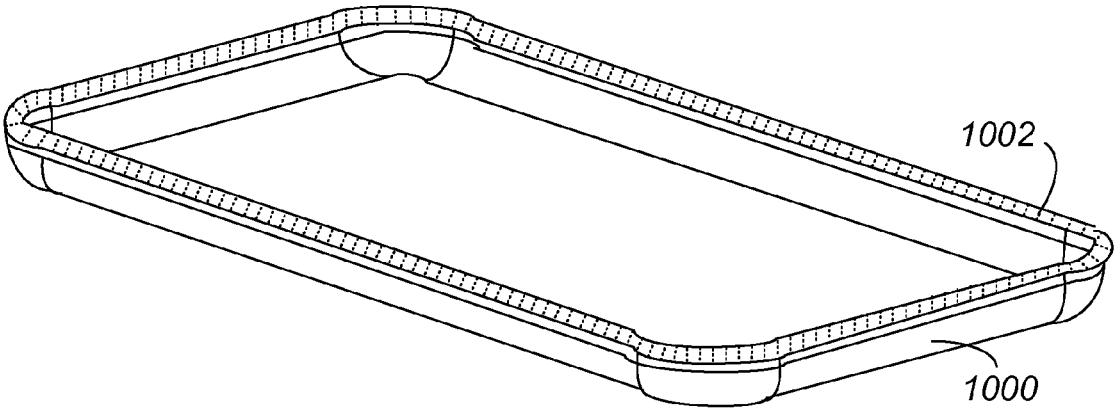
FIG. 10B is a diagrammatic representation of the same exemplary housing shown in FIG. 10A after a mask has been placed over an exposed stainless steel surface in accordance with one embodiment.

As described above, a substrate to be marked may included areas of exposed stainless steel, or areas in which stainless steel is not substantially covered by a laminant material. Such areas are generally masked prior to an anodizing process to protect the areas of exposed stainless steel from oxidizing or rusting. In one embodiment, an edge of a housing formed from a metal substrate having a laminant material may be masked with a masking material such that substantially only the laminant material, as for example aluminum, is exposed. FIG. 10A is a diagrammatic representation of an exemplary housing 1000 on which a mask is to be placed, and FIG. 10B is a diagrammatic representation of the same exemplary housing 1000 after a mask 1002 has been placed over an exposed stainless steel surface in accordance with an embodiment. The housing 1000 may be a housing that is to be a part of an overall assembly, as for example a bottom of a cell phone assembly or portable media player. As shown in FIG. 10B, the mask 1002 is applied to a top edge of the housing 1000.

Figure 11:
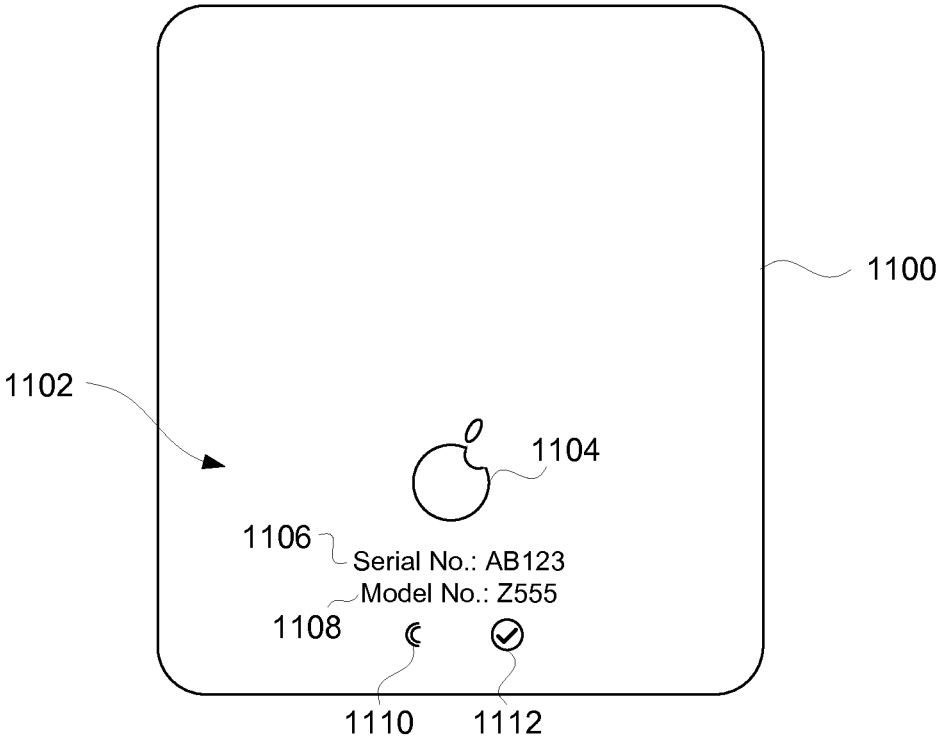
FIG. 11 illustrates the product housing having markings according to one exemplary embodiment.

FIG. 11 illustrates the product housing 1100 having markings 1102 according to one exemplary embodiment. The markings 1102 can be produced on a sub-surface of the product housing 1100 in accordance with any of the embodiment discussed above. In this example, the labeling includes a logo graphic 1104, serial number 1106, model number 1108, and certification/approval marks 1110 and 1112.

The marking processes described herein are, for example, suitable for applying text or graphics to a housing surface (e.g., an outer housing surface) of an electronic device. The marking processes are, in one embodiment, particularly well-suited for applying text and/or graphics to an outer housing surface of a portable electronic device. Examples of portable electronic devices include mobile telephones (e.g., cell phones), Personal Digital Assistants (PDAs), portable media players, remote controllers, pointing devices (e.g., computer mouse), game controllers, etc. The portable electronic device can further be a hand-held electronic device. The term hand-held generally means that the electronic device has a form factor that is small enough to be comfortably held in one hand. A hand-held electronic device may be directed at one-handed operation or two-handed operation. In one-handed operation, a single hand is used to both support the device as well as to perform operations with the user interface during use. In two-handed operation, one hand is used to support the device while the other hand performs operations with a user interface during use or alternatively both hands support the device as well as perform operations during use. In some cases, the hand-held electronic device is sized for placement into a pocket of the user. By being pocket-sized, the user does not have to directly carry the device and therefore the device can be taken almost anywhere the user travels (e.g., the user is not limited by carrying a large, bulky and often heavy device).

Additional information on product marking as well as other manufacturing techniques and systems for electronic devices are contained in U.S. Provisional Patent Application No. 61/059,789, filed Jun. 8, 2008, and entitled "Methods and Systems for Manufacturing an Electronic Device," which is hereby incorporated herein by reference.

This application is also references: (i) U.S. Provisional Patent Application No. 61/121,491, filed Dec. 10, 2008, and entitled "Techniques for Marking Product Housings," which is hereby incorporated herein by reference; (ii) U.S. patent application Ser. No. 12/358,647, filed Jan. 23, 2009, and entitled "Method and Apparatus for Forming a Layered Metal Structure with an Anodized Surface," which is hereby incorporated herein by reference; and (iii) U.S. patent application Ser. No. 12/475,597, filed May 31, 2009, and entitled "Techniques for Marking Product Housings," which is hereby incorporated herein by reference.

The various aspects, features, embodiments or implementations of the invention described above can be used alone or in various combinations.

Different aspects, embodiments or implementations may, but need not, yield one or more of the following advantages. One advantage of the invention is that durable, high precision markings can be provided to product housings. As an example, the markings being provided on a sub-surface of a product housing that not only have high resolution and durability but also provide a smooth and high quality appearance. Another advantage is that the marking techniques are effective for surfaces that are flat or curved.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. An electronic device housing, comprising:

a housing structure comprising:

an outer portion including an anodized layer on an aluminum layer;

an inner portion below the outer portion and including a stainless steel layer defining an interface between the stainless steel layer and the outer portion; and selectively altered surface regions formed at the interface between the stainless steel layer of the inner portion and the outer portion, wherein;

the altered surface regions provide predetermined marking of the electronic device housing, the electronic device housing provides at least a bottom of a housing for an electronic device, the electronic device being a mobile telephone or a portable media player, the predetermined marking by the altered surface regions causes one or more textual or graphical indicia to appear on the housing structure, the altered surface regions are formed after the outer portion has been anodized, the altered surface regions are altered through the outer portion that is anodized, and an outer surface of the anodized layer is without noticeable disturbance from the formation of the altered surface regions.

2. The electronic device housing as recited in claim 1, wherein the altered surface regions are formed at the interface between the stainless steel layer of the inner portion and the outer portion by a laser output through the outer portion that has been anodized.

3. The electronic device housing as recited in claim 2, wherein the laser is a picosecond pulsewidth infrared laser.

4. The electronic device housing as recited in claim 1, wherein the one or more textual or graphical indicia includes a standards mark or a certification mark.

5. The electronic device housing as recited in claim 1, wherein the one or more textual or graphical indicia appears black in color.

6. The electronic device housing as recited in claim 1;

wherein the altered surface regions cause one or more textual or graphical indicia to appear on the housing structure, and the one or more textual or graphical indicia pertain to at least one of agency approval for the electronic device or standards compliance by the electronic device.

7. The electronic device housing as recited in claim 1, wherein the outer portion is substantially translucent.

8. The electronic device housing as recited in claim 1, wherein the housing structure is a multi-layered structure.

9. The electronic device housing as recited in claim 8, wherein:

the outer surface corresponds to an outer layer of the multi-layered structure; and the inner portion surface corresponds to a surface of an inner layer of the multi-layered structure.

10. The electronic device housing as recited in claim 1, wherein the altered surface regions are formed at the interface between the stainless steel layer of the inner portion and the outer portion after the outer portion has been anodized without noticeable disturbance to the anodized outer portion.

11. The electronic device housing as recited in claim 1, wherein the altered surface regions at the interface between the stainless steel layer of the inner portion and the outer portion are altered through the outer portion that is anodized.

12. The electronic device housing as recited in claim 11, wherein the altered surface regions are formed at the interface between the stainless steel layer of the inner portion and the outer portion by a laser output through the outer portion that has been anodized.

13. A housing arrangement comprising:

a base metal layer comprising stainless steel;

additional layers comprising an anodized layer on a metal layer, the additional layers having a first bonding surface and a first exterior surface, the first bonding surface being bonded in direct contact between the metal layer and a first surface of the base metal layer and defining an interface between the base metal layer and the metal layer, the first exterior surface being an exterior of the housing arrangement; and sub-surface marking indicia formed at the interface between the base metal layer and the metal layer, wherein:

the housing arrangement provides at least a bottom of a housing for an electronic device, the electronic device being a mobile telephone or a portable media player, the sub-surface marking indicia regions cause one or more textual or graphical indicia to appear on the housing arrangement, the electronic device is a mobile telephone or a portable media player, the sub-surface marking indicia are formed at the interface between the base metal layer and the metal layer through the additional layers, and the sub-surface marking indicia formed at the interface between the base metal layer and the metal layer is done without noticeable disturbance to the anodized layer.

14. The housing arrangement as recited in claim 13, wherein the first exterior surface is anodized prior to forming the sub-surface marking indicia.

15. The housing arrangement as recited in claim 13, wherein the sub-surface marking indicia provide predetermined marking of the housing arrangement.

16. The housing arrangement as recited in claim 13, wherein the metal layer of the housing arrangement comprises aluminum.

17. The housing arrangement as recited in claim 16, wherein the sub-surface marking indicia provide predetermined marking of the housing arrangement.

18. The housing arrangement as recited in claim 17, wherein:

the first exterior surface is anodized prior to forming the sub-surface marking indicia, and the sub-surface marking indicia are formed at the interface between the base metal layer and the metal layer by a laser through the through the metal layer.

19. The housing arrangement as recited in claim 18, wherein the laser is a picosecond pulsewidth infrared laser.

20. A metal housing for an electronic device comprising:

a metal structure comprising:

a substrate comprising stainless steel;

a layer of anodizable metal; and a layer of anodized metal, the layer of anodizable metal being adhered to an upper surface of the substrate defining a boundary between the substrate and the layer of anodizable metal;

wherein:

altered surfaces are formed at the boundary between the upper surface of the substrate and the layer of anodizable metal;

the altered surfaces provide markings on the metal structure visible through the layer of anodized metal and layer of anodizable metal; and the layer of anodized metal forms at least a portion of an exterior surface of the metal housing for the electronic device.

* * * * *